US008407826B2

(12) United States Patent
Lev et al.

(10) Patent No.: US 8,407,826 B2
(45) Date of Patent: Apr. 2, 2013

(54) BATH APPARATUS

(75) Inventors: Mordechai Lev, West Bloomfield, MI (US); Roman S. Ferber, West Bloomfield, MI (US); Stephen Chung, Taipei (TW)

(73) Assignee: FKA Distributing Co., LLC, Commerce Township, MI (US)

( * ) Notice: Subject to any disclaimer, the term of this patent is extended or adjusted under 35 U.S.C. 154(b) by 1659 days.

(21) Appl. No.: 11/084,302

(22) Filed: Mar. 18, 2005

(65) Prior Publication Data

US 2005/0235411 A1 Oct. 27, 2005

Related U.S. Application Data

(60) Provisional application No. 60/554,474, filed on Mar. 19, 2004.

(51) Int. Cl.
*A47K 3/022* (2006.01)
*A61H 35/00* (2006.01)
*E03C 1/00* (2006.01)

(52) U.S. Cl. ..... 4/622

(58) Field of Classification Search ..... 4/621–662, 4/541.1–541.6; 601/166, 154–160, 15, 17; 607/81, 86

See application file for complete search history.

(56) References Cited

U.S. PATENT DOCUMENTS

| | | | | |
|---|---|---|---|---|
| 2,729,087 | A * | 1/1956 | Harrell | 68/131 |
| 4,523,580 | A * | 6/1985 | Tureaud | 601/104 |
| 6,309,366 | B1 | 10/2001 | Maxwell | |
| 6,385,795 | B1 * | 5/2002 | Ferber et al. | 4/622 |
| 6,393,633 | B2 | 5/2002 | Ferber | |
| 6,405,390 | B2 | 6/2002 | Kuen | |
| 6,505,358 | B2 * | 1/2003 | Ferber et al. | 4/622 |
| 6,568,000 | B1 * | 5/2003 | Kaufman et al. | 4/622 |
| 6,695,800 | B1 | 2/2004 | Gary et al. | |
| 6,698,038 | B2 * | 3/2004 | Bastia et al. | 4/622 |
| 6,805,678 | B2 * | 10/2004 | Cafaro | 601/16 |
| 6,973,683 | B2 * | 12/2005 | Lev et al. | 4/622 |
| 7,065,808 | B2 * | 6/2006 | Leung et al. | 4/622 |
| 7,100,220 | B2 * | 9/2006 | Lev et al. | 4/622 |
| 2002/0013964 | A1 * | 2/2002 | Kuen | 4/622 |
| 2002/0133872 | A1 * | 9/2002 | Ferber | 4/622 |
| 2003/0126679 | A1 * | 7/2003 | Leung et al. | 4/622 |
| 2003/0220593 | A1 * | 11/2003 | Morton | 601/15 |
| 2003/0226201 | A1 * | 12/2003 | Leung et al. | 4/622 |
| 2004/0002666 | A1 | 1/2004 | Chen | |
| 2004/0194205 | A1 * | 10/2004 | Leung | 4/622 |
| 2005/0076433 | A1 * | 4/2005 | Leung | 4/622 |
| 2005/0097669 | A1 * | 5/2005 | Tobin et al. | 4/622 |
| 2005/0187496 | A1 | 8/2005 | Ho | |
| 2006/0026753 | A1 * | 2/2006 | Leung | 4/622 |
| 2007/0050906 | A1 * | 3/2007 | Cohen et al. | 4/622 |

FOREIGN PATENT DOCUMENTS

GB 2156218 A * 10/1985

* cited by examiner

*Primary Examiner* — Tuan N Nguyen
(74) *Attorney, Agent, or Firm* — Brooks Kushman P.C.

(57) ABSTRACT

An apparatus for bathing a body part, such as the feet, includes a bath chamber for containing a fluid and receiving the body part therein. The bath chamber includes a bottom surface and a wall structure extending upwardly therefrom, where a motor is mounted on an underside of the bottom surface. At least one therapy center is disposed on the bottom surface and operably connected to the motor for providing therapy to the body part when the body part is placed on the at least one therapy center.

19 Claims, 4 Drawing Sheets

BATH APPARATUS

CROSS-REFERENCE TO RELATED APPLICATIONS

This application claims the benefit of U.S. provisional application Ser. No. 60/554,474 filed Mar. 19, 2004.

BACKGROUND OF THE INVENTION

1. Field of the Invention

This invention relates to an apparatus for bathing body parts, such as the feet or hands.

2. Background Art

Most people experience foot problems at some time in their lives. This is not surprising, considering that many people are employed in jobs that require them to be on their feet all day. In fact, even an average day of walking can exert force equal to several hundred tons of pressure on the feet.

In an attempt to alleviate a variety of podiatric problems, bathing of the feet has become a recognized therapeutic method. For example, soaking soothes the feet and aids in recovery from fatigue. Bathing of the feet also stimulates the circulation of blood therethrough, which results in increased metabolism and excretion. In addition, foot bathing facilitates the removal of painful growths such as calluses, bunions, and corns.

Many types of foot baths have been utilized as therapeutic devices for the feet. Typically, foot baths provide heated water for which the temperature is maintained via electrical means. In addition, current foot baths often provide massage to the feet through vibration of the foot bath. Vibratory massage enhances the therapeutic results achieved with soaking alone by further increasing circulation, as well as relaxing and massaging the muscles.

While heat and vibration applied to the feet in an overall manner is helpful, many conventional foot baths are not designed with the capability to target specific areas of the feet. For example, it is common for a user to wish to concentrate treatment to a specific part or parts of his/her feet such as the ball, heel, or arch. Therefore, a need exists for a bath apparatus with the capability to focus therapy at specific locations of the body. Furthermore, it is advantageous to allow a user to accomplish targeted therapy of both feet simultaneously, and preferably while maintaining their feet in the bath. Such a bath apparatus would not only allow users to tailor therapy regimens to their individual needs, but would also increase the speed at which therapy can be accomplished, thereby increasing the convenience for the user.

SUMMARY OF THE INVENTION

Accordingly, an apparatus for bathing a body part, such as the feet, is provided which includes a bath chamber for containing a fluid and receiving the body part therein, the bath chamber including a bottom surface and a wall structure extending upwardly therefrom. A motor is mounted on an underside of the bottom surface, and at least one therapy center is disposed on the bottom surface and operably connected to the motor for providing therapy to the body part when the body part is placed on the therapy center.

Each therapy center is arranged to receive a therapy attachment, where the therapy attachments can include features such as raised nodes or a brush. The motor can impart rotary motion to the therapy attachment via a gear train, the gear train having at least one gear shaft extending through an aperture on the bottom surface and arranged to receive the therapy attachment. According to one aspect of the present invention, a seal can be disposed on the gear shaft beneath the bottom surface to prevent fluid from leaking out of the bath chamber. A switch is provided for providing power to the motor, where the switch can be a multi-function switch that allows for multiple modes of activation of the therapy center. According to another aspect of the present invention, the therapy center can be activated by pressure of the body part on the therapy center.

A hood is attached to the wall structure and arranged to at least partially cover the bath chamber. In accordance with one aspect of the present invention, the hood is hollow to define a storage area therein arranged to store therapy attachments when not in use. A lid can be attached to the hood for providing access to the storage area, where the lid can be constructed of a generally transparent material. The bottom surface of the bath chamber can include a plurality of raised portions.

According to another aspect of the present invention, the apparatus further includes a heating member arranged to remain uncovered by fluid for providing heat to the body part when the body part is placed thereon. A heater can also be provided in communication with the bottom surface for maintaining the heat of the fluid contained within the bath chamber. In addition, an air pump can be provided along with at least one outlet tube in communication with the pump. The outlet tube is in communication with a plurality of egress holes provided in the bath chamber bottom surface through which air from the pump is directed into the bath chamber in order to generate air bubbles in the fluid contained therein. Still further, a vibration assembly can be provided in communication with the bath chamber for imparting vibration to the bath chamber.

In further accordance with the present invention, a foot bath apparatus is provided which includes a bath chamber for containing a fluid and receiving a user's feet therein, the bath chamber including a bottom surface and a wall structure extending upwardly therefrom. A motor is mounted on an underside of the bottom surface, and at least two spaced therapy centers are disposed on the bottom surface and operably connected to the motor, each therapy center arranged to receive a rotatable therapy attachment for providing therapy to the feet. A seal is disposed beneath the bath chamber bottom surface to prevent fluid from leaking out of the bath chamber.

Furthermore, in accordance with the present invention, a foot bath apparatus is provided having a bath chamber for containing a fluid and receiving a user's feet therein, the bath chamber including a bottom surface and a wall structure extending upwardly therefrom. A motor is mounted on an underside of the bottom surface, and at least two spaced therapy centers are disposed on the bottom surface and operably connected to the motor, each therapy center arranged to receive a rotatable therapy attachment for providing therapy to the feet. A hood is attached to the wall structure and arranged to at least partially cover the bath chamber, wherein the hood is hollow to define a storage area therein arranged to store the therapy attachments when not in use.

The above features and advantages, along with other features and advantages of the present invention are readily apparent from the following detailed description of the invention when taken in connection with the accompanying drawings.

DETAILED DESCRIPTION OF THE PREFERRED EMBODIMENT(S)

Figure 2:
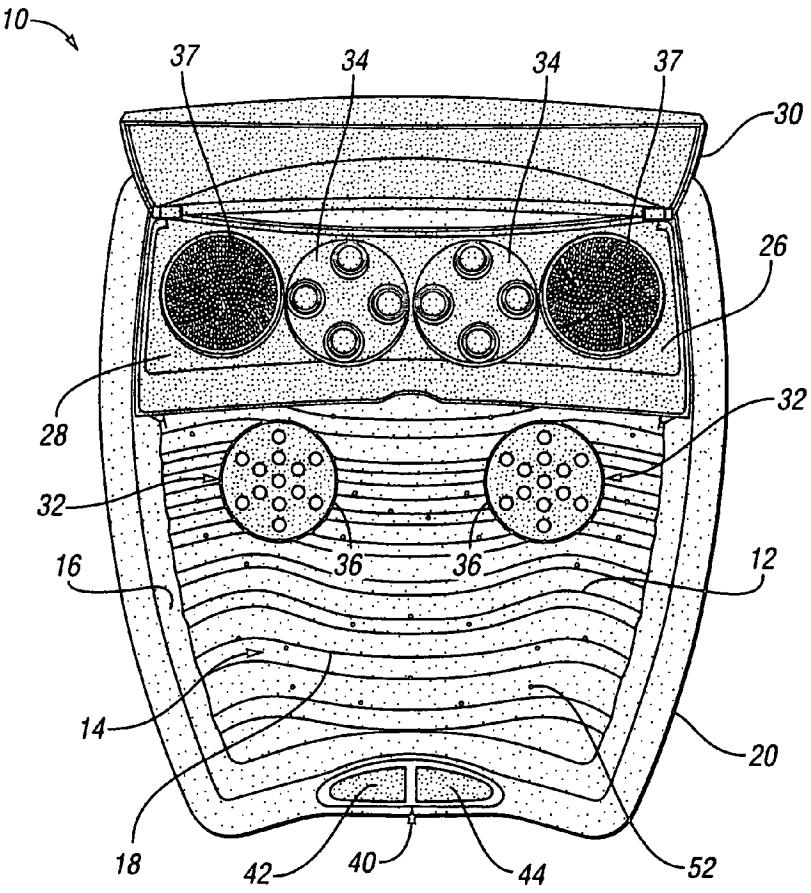
FIG. 2 is a top plan view of the foot bath apparatus shown in FIG. 1 showing the lid of the hood storage area in an open position.
Figure 1:
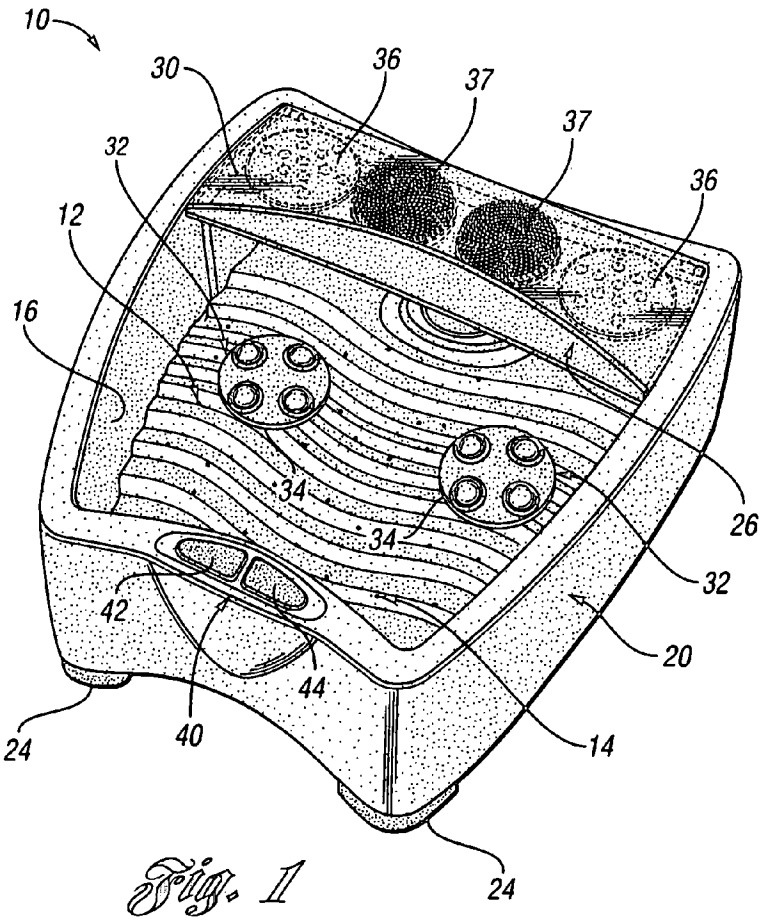
FIG. 1 is a perspective view of a foot bath apparatus according to the present invention.

Referring first to FIGS. 1-2, a bath apparatus constructed according to the present invention is depicted and designated generally by reference numeral 10. Bath apparatus 10 can be used to provide bubbles, massage, and other therapy to body parts, such as the feet. Bath apparatus 10 is preferably constructed from a plastic material so as to be lightweight and portable, as well as durable, leakproof, and corrosion resistant. Although bath apparatus 10 is illustrated and described herein as being particularly adaptable for use as a foot bath, it is understood that bath apparatus 10 of the present invention may be used for bathing other body parts, such as the hands.

Bath apparatus 10 includes a bath chamber 12 for containing fluid, such as water, and receiving the body part, such as the foot, therein. Bath chamber 12 includes a bottom surface 14 and a wall structure 16 extending upwardly therefrom. Bottom surface 14 can be generally parallel to a supporting surface on which bath apparatus 10 is placed or, alternatively, bottom surface 14 could be slanted downward toward the user. Bath chamber 12 is of a length and width to accommodate the feet of an adult user, such that sufficient space is provided to permit the user to readily insert and remove his/her feet and to allow each foot to be moved about somewhat while in position within bath chamber 12. For use, bath chamber 12 is filled with water such that a user, preferably seated, submerses his/her feet up to approximately the height of the ankles.

Figure 4:
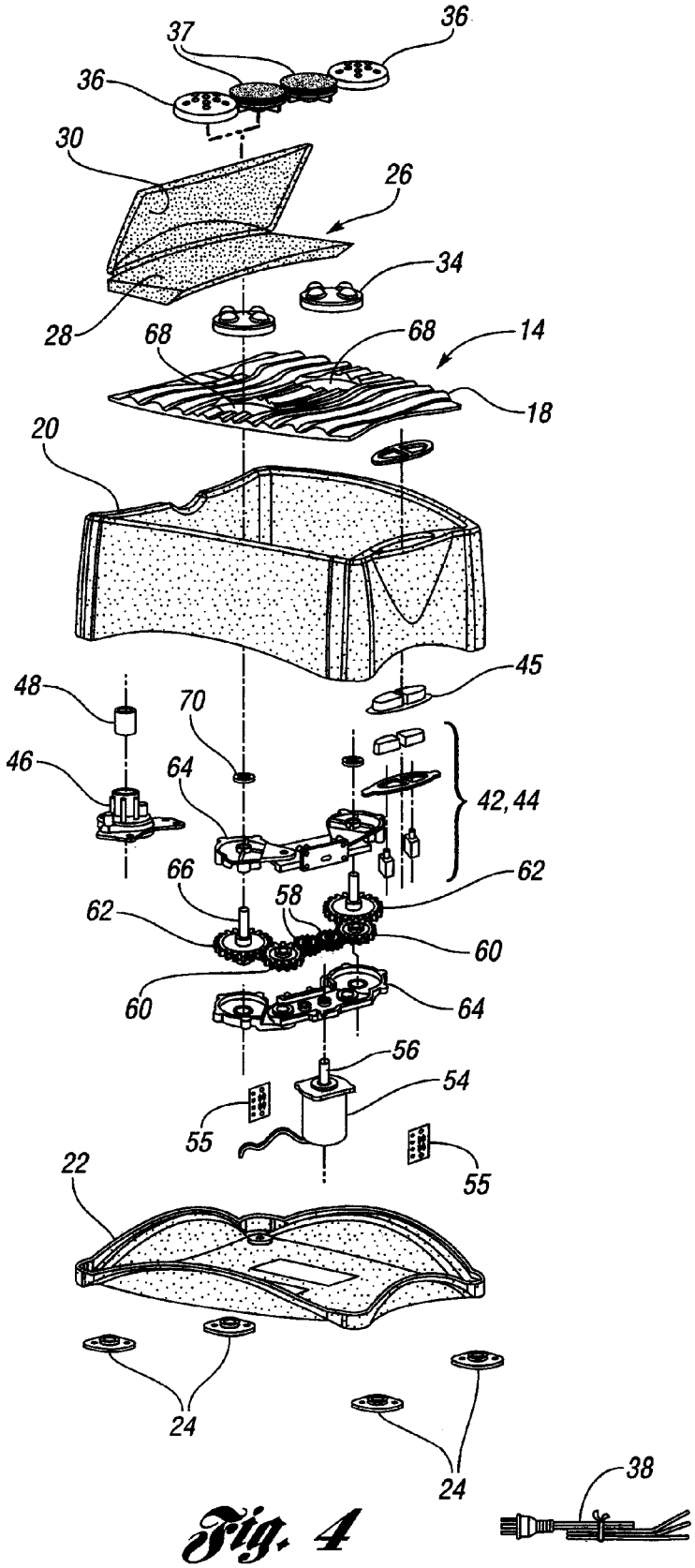
FIG. 4 is an exploded view of a foot bath apparatus according to the present invention.

Referring again to the top plan view of FIG. 2 and the exploded view of FIG. 4, bottom surface 14 of bath chamber 12 preferably includes a plurality of raised portions 18 having a generally wavelike configuration. Of course, other shapes, sizes, and configurations of raised portions 18 are fully contemplated according to the present invention. Raised portions 18 function to massage the feet upon contact, and also allow water and heat to flow under the feet to improve blood circulation.

With reference to FIGS. 1-2 and 4, bath apparatus 10 includes a housing 20 which encases bath chamber 12 and may be constructed of multiple pieces. Housing 20 is spaced from an underside of bath chamber bottom surface 14 to provide a location for housing the various mechanical/electrical assemblies of bath apparatus 10 described below with reference to FIGS. 3-6. As best shown in FIG. 4, housing 20 includes a base 22 which is preferably provided with feet 24 attached thereto, wherein feet 24 are preferably constructed from a material such as rubber to prevent movement of bath apparatus 10 along a supporting surface. A hand slot (not shown) can be provided within housing 20 to facilitate carrying of bath apparatus 10.

Referring again to FIGS. 1-2 and 4, bath apparatus 10 further includes a hood 26 adapted to be attached to wall structure 16 to at least partially cover bath chamber 12. Hood 26 is shown herein to be configured for a hinged attachment to wall structure 16, but could also be configured for other types of attachment, for example, a snap-fit attachment. Alternatively, hood 26 could be integrally formed with wall structure 16. Hood 26 is preferably constructed from a plastic material, and is hollow to define a storage area 28 therein which can be used to store one or more therapy attachments when not in use (best shown in FIGS. 2 and 4). Hood 26 preferably includes a lid 30 hingedly attached thereto which can be used to provide access to storage area 28. In a preferred embodiment, lid 30 is constructed of a generally transparent material such that the contents of storage area 28 can be easily ascertained even when lid 30 is in a closed position.

As shown in FIGS. 1 and 2, bottom surface 14 includes one or more therapy centers 32 which allow for different types of therapy to be targeted to specific locations of the foot such as the ball, heel, or arch. Advantageously, placement of a user's feet on therapy centers 32 allows for both feet to receive targeted therapy simultaneously while the feet are still submersed in the water filling bath chamber 12. Therapy centers 32 are arranged to receive various therapy attachments, such as attachment 34 shown in FIG. 1 or attachment 36 shown in FIG. 2, wherein movement of the therapy attachments is motorized as described below with reference to FIGS. 3 and 4. Use of therapy centers 32 helps relieve tightness and tiredness along soles of feet, as well as for reflexology purposes. While two spaced therapy centers 32 are shown and described herein, it is understood that any number and placement of the therapy centers 32 within bottom surface 14 is contemplated in accordance with the present invention.

Several therapy attachments for use with bath apparatus 10 of the present invention are depicted in FIGS. 1-2 and 4, wherein the therapy attachments can be easily interchanged by a user. Therapy attachments 34 and 36 are generally circular and each include raised nodes which provide pressure points to gently massage a user's foot when contacted. Another therapy attachment 37 includes a brush to clean and exfoliate skin. It is understood that the particular therapy attachments shown and described herein are merely exemplary, and that any other therapy attachments suitable for operating within the fluid contained in bath chamber 12 can be used in accordance with the present invention.

Bath apparatus 10 receives power through an electrical cord 38 (FIG. 3), which is configured to plug into a standard electrical outlet. Alternatively, bath apparatus 10 could be battery-operated. Because bath apparatus 10 may include devices and electrical circuits that require a voltage other than that provided by a standard electrical outlet, a transformer (not shown) can be provided. Referring again to FIGS. 1-2, a switch assembly 40 is located on wall structure 16 of bath chamber 12, wherein switch assembly 40 includes switches 42, 44 which can be depressed by a user to selectively provide power to a pump 46 to provide air bubbles to bath chamber 12, to selectively provide power to a motor 54 for the activation of therapy attachments 34, 36, 37, to provide targeted or widespread heat within bath chamber 12, to provide vibration of bath chamber 12, or a combination of any of these functions. Of course, it is understood that other combinations of bath functions are fully contemplated in accordance with the present invention, and switch assembly 40 can include a greater number of switches if required.

In a preferred embodiment, switches 42, 44 are standard push-push (push ON, push OFF) switches which are in communication with pump 46 and motor 54 (described below with reference to FIGS. 3-4) via printed circuit boards 55. Switches 42, 44 each include a flexible, preferably rubber, cover 45 which provides a waterproof design yet is flexible enough to allow for depression using a user's foot or toe. As an alternative to a push-push type switch, switches 42, 44 could be multi-function switches in order to allow for multiple modes of activation, such as multiple bubble intensities or movement speeds of therapy attachments 34, 36, 37, with every press. Additionally, it is contemplated that switch assembly 40 could be replaced by a rotatable selector knob.

Figure 3:
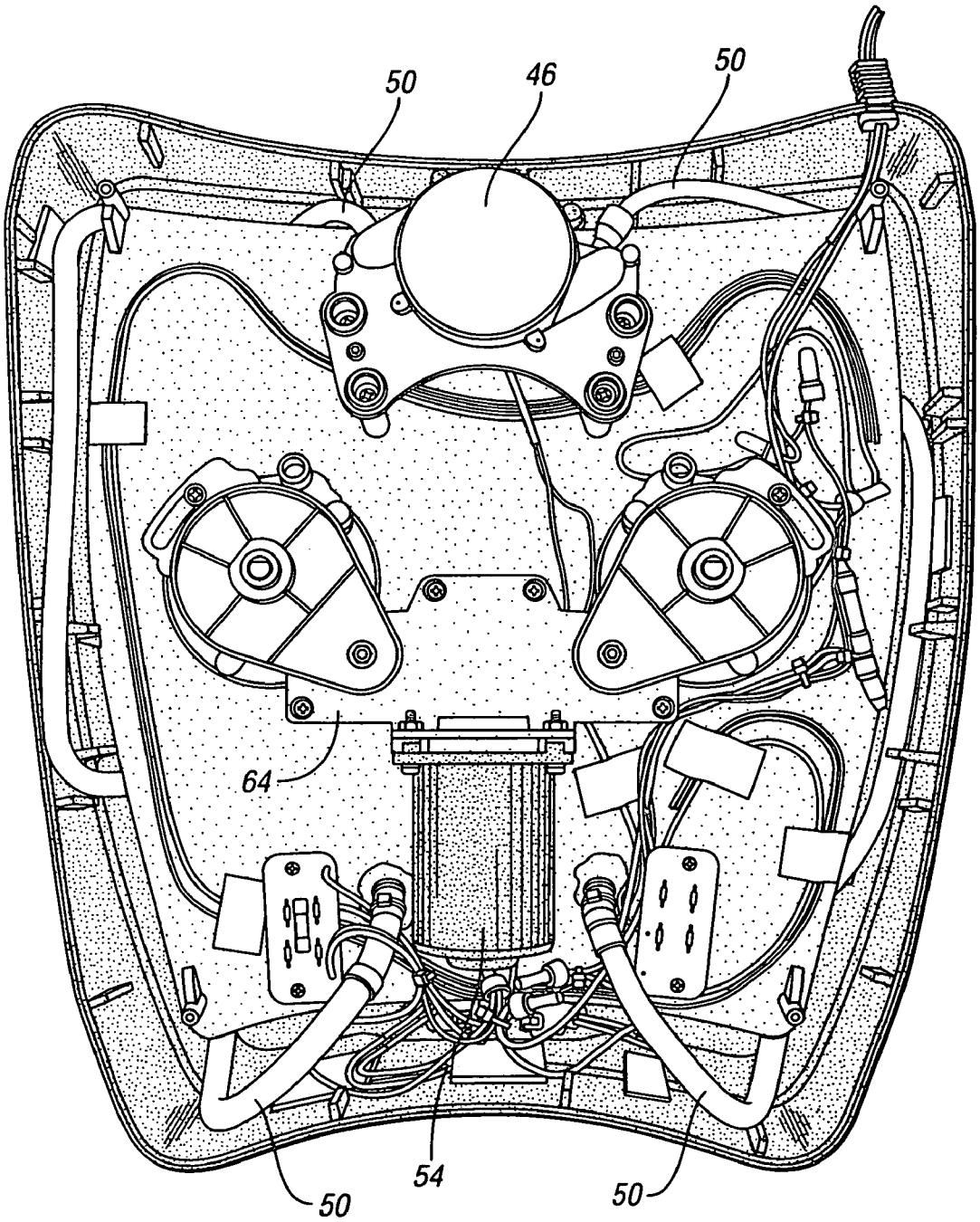
FIG. 3 is a bottom plan view of the foot bath apparatus shown in FIG. 1 where the housing has been removed.

With reference to FIGS. 3-6, the mechanical/electrical assemblies of bath apparatus 10 which function to provide bubbles, heat, vibration, and movement of therapy centers 32 will now be described. These assemblies are housed in the space between bath chamber 12 and housing 20 and are selectively powered as determined by the actuation of switches 42, 44. As shown in FIGS. 3-6, bath apparatus 10 includes a pump 46 and corresponding motor 48 mounted adjacent to bottom surface 14 of bath chamber 12 and in communication therewith. Pump 46 directs air into bath chamber 12 to generate air bubbles in the water contained therein. As shown in FIG. 3, pump 46 forces air through outlet tubes 50 which are in communication with a plurality of egress holes 52 (best shown in FIG. 2) formed throughout bath chamber bottom surface 14, further details of which can be found in U.S. Pat. Nos. 6,385,795; 6,393,633; and 6,568,000; each of which is incorporated by reference herein. Air is forced out of egress holes 52 to form air bubbles in the water contained in bath chamber 12. Although egress holes 52 are depicted herein as being disposed generally uniformly across bottom surface 14, it is understood that other configurations of egress holes 52 are fully contemplated in accordance with the present invention.

For the operation of therapy centers 32, a motor 54 is mounted on an underside of bath chamber bottom surface 14 as shown in FIGS. 3-4. Motor 54 imparts rotary motion via a multi-stage gear train to therapy attachments 34, 36, 37 accessible on bottom surface 14. Specifically, motor 54 includes a threaded output shaft 56 that is rotatably driven by motor 54 and engages inner gears 58 on either side thereof. Inner gears 58, in turn, engage intermediate gears 60, which in turn engage outer gears 62. As shown in FIGS. 3 and 4, the gear train is disposed within a gear box 64, typically of two-piece construction. Each outer gear 62 includes a gear shaft 66 protruding upwardly therefrom, where gear shafts 66 extend through apertures 68 (see FIG. 4) provided in bottom surface 14. Seals 70 sized to be received on gear shafts 66 are provided to protect against leakage of fluid beneath bath chamber bottom surface 14 and out of bath chamber 12. Although a specific gear train configuration is shown and described herein, it is understood that other gear assemblies could be used to affect rotation of the therapy attachments 34, 36, 37 in accordance with the present invention.

With continuing reference to FIG. 4, gear shafts 66 are configured to be securely received in a recess (not shown) provided on the underside of each therapy attachment 34, 36, 37, such that the therapy attachment will rotate along with gear shafts 66 even when in contact with a user's foot. For example, gear shafts 66 and the corresponding attachment recesses could be hexagonal in shape, or have any other shape suitable for providing secure mating of gear shafts 66 and the therapy attachments 34, 36, 37 without slippage during rotation. Of course, it is understood that therapy attachments 34, 36, 37 could instead each have a projection that is received in a recess formed in gear shaft 66, and that alternative mating configurations of gear shafts 66 and therapy attachments 34, 36, 37 are fully contemplated according to the present invention. When secured as shown in FIGS. 1 and 2, therapy attachments 34, 36, 37 extend slightly above bottom surface 14.

Although the activation of motor 54 is preferably provided upon depression of a push-push type switch, the motorized rotation of therapy attachments 34, 36, 37 could alternatively be activated by pressure of a user's foot applied thereon, which then would establish electrical contact to supply power to motor 54. In this case, the operation of motor 54 would not governed by switches 42, 44, but rather power would be supplied to motor 54 as long as bath apparatus 10 was plugged in.

Figure 5:
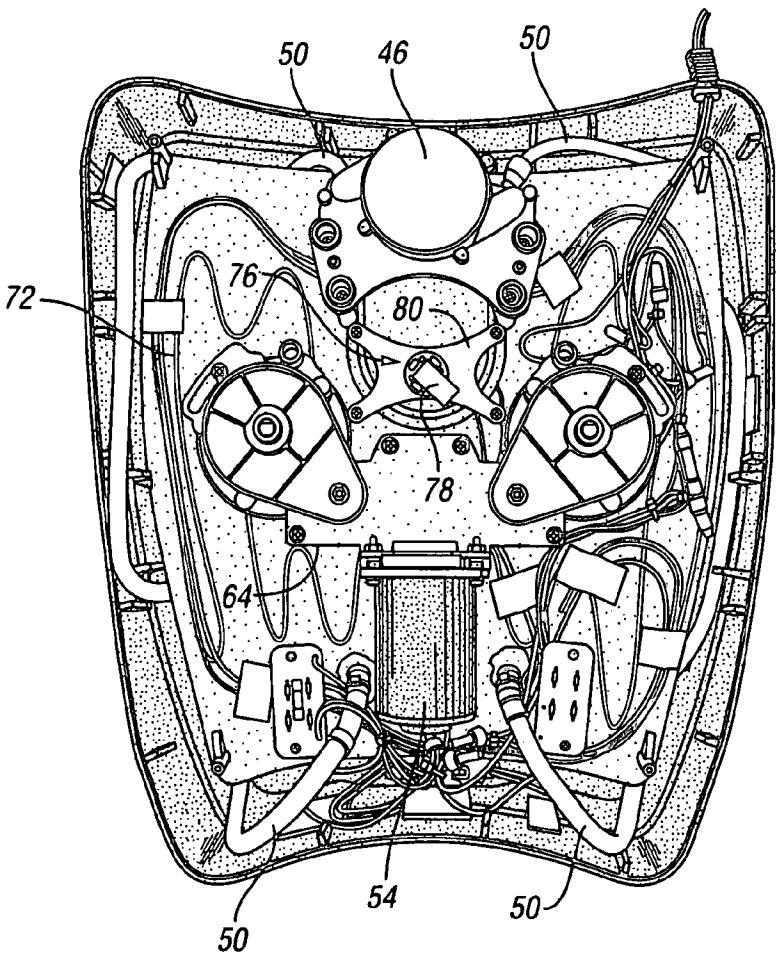
FIG. 5 is a bottom plan view of a foot bath apparatus according to another aspect of the present invention.

In order to maintain the heat of water in bath chamber 12, bath apparatus 10 can include a heater 72 in communication with bath chamber 12 as depicted in FIG. 5. Heater 72 can comprise a resistive heating element, such as a rope heating element, secured underneath bottom surface 14 of bath chamber 12, although the use of other types of heaters is contemplated. Heater 72 is operable to conduct heat to the water contained within bath chamber 12, where the heated water relieves tired muscles and promotes circulation of the blood.

Figure 6:
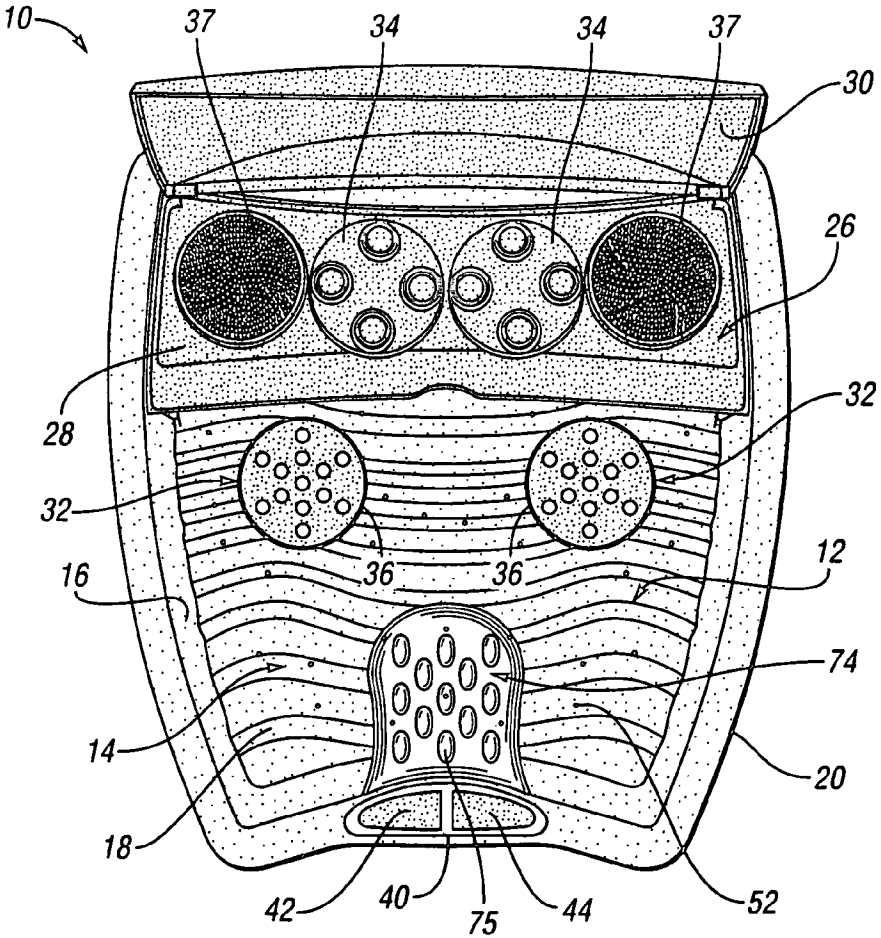
FIG. 6 is a top plan view of a foot bath apparatus according to another aspect of the present invention.

As shown in FIG. 6, a heating member 74 can be disposed at any location within bath apparatus 10 that is external to the water for providing heat to the foot surface when the foot is placed thereon. Advantageously, heating member 74 provides the capability of focusing heat on the specific region of the foot desired by the user. According to one aspect of the present invention, heating member 74 uses infrared rays. Infrared rays allow heat to penetrate deep underneath the surface of the skin, causing the pores of the skin to be opened and promoting metabolism and excretion of the body through increased blood circulation. The applied pressure of the foot on heating member 74 can be adjusted by the user for optimum comfort. Heating member 74 can include raised nodes 75 to provide gently concentrated pressure to a user's foot. Of course, heating member 74 could alternatively be generally flat or could have any other contour suitable for contact with a user's foot.

In addition, a vibration assembly 76 can be provided in communication with bath chamber 12 as shown in FIG. 5 for imparting vibration to bath chamber 12 to provide a massaging effect to the feet. According to one aspect of the present invention, vibration assembly 76 includes a motor (not shown) affixed underneath bottom surface 14, an output shaft (not shown) rotatably driven by the motor, and a counterweight 78 affixed to the output shaft. Vibration assembly 76 is mounted beneath bottom surface 14 by a support bracket 80. When the motor is electrically powered, rotation of the output shaft and attached counterweight 78 imparts vibrations to support bracket 80, and these vibrations are then transferred to bath chamber 12 and the water contained therein in order to massage the feet. It is contemplated that variable vibration intensities could be provided in accordance with the present invention. Heater 72, heating member 74, and vibration assembly 76 are each fully described in U.S. Pat. Nos. 6,385,795; 6,393,633; and 6,568,000 which are incorporated by reference herein.

Although a rotary motion of therapy attachments 34, 36, 37 is shown and described herein, it is understood that motor 54 could alternatively be employed to create other types of movement of therapy attachments 34, 36, 37 such as, but not limited to, oscillating, reciprocating, and vibratory motion. For example, an oscillating movement of therapy attachments 34, 36, 37 could be created by reversing the direction of motor 54 at certain intervals, and a vibratory movement of therapy attachments 34, 36, 37 could be created through use of a motor and counterweight similar to vibration assembly 76.

While embodiments of the invention have been illustrated and described, it is not intended that these embodiments illustrate and describe all possible forms of the invention.

Rather, the words used in the specification are words of description rather than limitation, and it is understood that various changes may be made without departing from the spirit and scope of the invention.

What is claimed is:

1. An apparatus for bathing a body part, the apparatus comprising:

a bath chamber for containing a fluid and receiving the body part therein, the bath chamber including a bottom surface and a wall structure extending upwardly therefrom;

a motor mounted on an underside of the bottom surface; and at least one therapy attachment removably received on the bottom surface and operably connected to the motor for imparting rotary motion to the therapy attachment and providing therapy to the body part when the body part is placed in contact with the therapy attachment.

2. The apparatus according to claim 1, wherein the motor imparts rotary motion to the therapy attachment via a gear train, the gear train having at least one gear shaft extending through an aperture on the bottom surface and arranged to receive the therapy attachment.

3. The apparatus according to claim 2, further comprising a seal disposed on the at least one gear shaft beneath the bottom surface to prevent fluid from leaking out of the bath chamber.

4. The apparatus according to claim 1, wherein the therapy attachment includes raised nodes.

5. The apparatus according to claim 1, wherein the therapy attachment includes a brush.

6. The apparatus according to claim 1, further comprising a switch for providing power to the motor.

7. The apparatus according to claim 6, wherein the switch is a multi-function switch that allows for multiple modes of activation of the at least one therapy attachment.

8. The apparatus according to claim 1, wherein the at least one therapy attachment is activated by pressure of the body part on the therapy attachment.

9. The apparatus according to claim 1, further comprising a hood attached to the wall structure and arranged to at least partially cover the bath chamber.

10. The apparatus according to claim 9, wherein the hood is hollow to define a storage area therein arranged to store therapy attachments when not in use.

11. The apparatus according to claim 10, further comprising a lid attached to the hood for providing access to the storage area.

12. The apparatus according to claim 11, wherein the lid is constructed of a generally transparent material.

13. The apparatus according to claim 1, further comprising a heating member arranged to remain uncovered by fluid for providing heat to the body part when the body part is placed thereon.

14. The apparatus according to claim 1, further comprising a heater in communication with the bottom surface for maintaining the heat of the fluid contained within the bath chamber.

15. The apparatus according to claim 1, further comprising an air pump and at least one outlet tube in communication with the pump, the at least one outlet tube in communication with a plurality of egress holes provided in the bath chamber bottom surface through which air from the pump is directed into the bath chamber in order to generate air bubbles in the fluid contained therein.

16. The apparatus according to claim 1, further including a vibration assembly in communication with the bath chamber for imparting vibration to the bath chamber.

17. The apparatus according to claim 1, wherein the bottom surface includes a plurality of raised portions.

18. A foot bath apparatus, comprising:

a bath chamber for containing a fluid and receiving a user's feet therein, the bath chamber including a bottom surface and a wall structure extending upwardly therefrom;

a motor mounted on an underside of the bottom surface;

at least two spaced therapy centers disposed on the bottom surface and operably connected to the motor, each therapy center including a removable, rotatable therapy attachment for providing therapy to the feet; and a seal disposed beneath the bath chamber bottom surface to prevent fluid from leaking out of the bath chamber.

19. A foot bath apparatus, comprising:

a bath chamber for containing a fluid and receiving a user's feet therein, the bath chamber including a bottom surface and a wall structure extending upwardly therefrom;

a motor mounted on an underside of the bottom surface;

at least two spaced therapy centers disposed on the bottom surface and operably connected to the motor, each therapy center including a removable, rotatable therapy attachment for providing therapy to the feet; and a hood attached to the wall structure and arranged to at least partially cover the bath chamber, wherein the hood is hollow to define a storage area therein arranged to store the therapy attachments when not in use.

* * * * *